US010293990B2

(12) United States Patent
Geiger

(10) Patent No.: US 10,293,990 B2
(45) Date of Patent: May 21, 2019

(54) CLOSURE SYSTEM AND CONTAINER HAVING A CLOSURE SYSTEM

(71) Applicant: Hoffmann Neopac AG, Thun (CH)

(72) Inventor: Andreas Geiger, Heimberg (CH)

(73) Assignee: Hoffmann Neopac AG, Thun (CH)

( * ) Notice: Subject to any disclaimer, the term of this patent is extended or adjusted under 35 U.S.C. 154(b) by 71 days.

(21) Appl. No.: 15/292,526

(22) Filed: Oct. 13, 2016

(65) Prior Publication Data

US 2017/0129657 A1 May 11, 2017

(30) Foreign Application Priority Data

Nov. 6, 2015 (CH) ..... 1614/15

(51) Int. Cl.

| | |
|---|---|
| ***B65D 35/46*** | (2006.01) |
| ***B65D 47/20*** | (2006.01) |
| ***B65D 41/62*** | (2006.01) |
| ***B65D 35/38*** | (2006.01) |

(52) U.S. Cl.

CPC ..... *B65D 41/62* (2013.01); *B65D 35/38* (2013.01); *B65D 35/46* (2013.01); *B65D 47/20* (2013.01); *B65D 47/2068* (2013.01)

(58) Field of Classification Search

CPC .. B43K 5/1845; B65D 35/46; B65D 47/2018; B65D 47/2056; B65D 47/24

USPC ..... 401/264

See application file for complete search history.

(56) References Cited

U.S. PATENT DOCUMENTS

| | | | | |
|---|---|---|---|---|
| 2,075,249 | A * | 3/1937 | Wilson | B65D 47/242 137/377 |
| 2,711,271 | A * | 6/1955 | Schlicksupp | B65D 35/46 222/493 |
| 4,511,273 | A * | 4/1985 | Trotta | B43K 5/1845 401/264 |
| 6,332,730 | B1 * | 12/2001 | Taghavi-Khanghah | B65D 35/20 222/212 |
| 2002/0030069 | A1 * | 3/2002 | Auer | B65D 35/20 222/481.5 |
| 2004/0134940 | A1 * | 7/2004 | Hearld | B65D 47/0828 222/481.5 |
| 2010/0230376 | A1 | 9/2010 | De Rosa et al. | |
| 2013/0200099 | A1 * | 8/2013 | Abe | B65D 35/14 222/95 |
| 2014/0048570 | A1 * | 2/2014 | Brall | B65D 35/46 222/496 |
| 2015/0090744 | A1 * | 4/2015 | Jung | B65D 35/46 222/496 |

FOREIGN PATENT DOCUMENTS

| | | |
|---|---|---|
| DE | 10157423 | 6/2003 |
| EP | 1188679 | 3/2002 |
| EP | 2537773 | 12/2012 |
| JP | S6282953 | 5/1987 |

* cited by examiner

*Primary Examiner* — David P Angwin
*Assistant Examiner* — Bradley S Oliver
(74) *Attorney, Agent, or Firm* — Volpe and Koenig, P.C.

(57) ABSTRACT

The closure system includes an applicator having a closing member (7) which is realized for closing an outlet opening (11) as a result of the restoring force of a resilient restoring element. A blocking element (19) is movable such that, in a blocking position, it retains the closing member (7) in the closed position, but in the open position allows the outlet opening (11) to open.

10 Claims, 3 Drawing Sheets

CLOSURE SYSTEM AND CONTAINER HAVING A CLOSURE SYSTEM

INCORPORATION BY REFERENCE

The following documents are incorporated herein by reference as if fully set forth: Swiss Patent Appln. No. 01614/15, filed Nov. 6, 2015.

BACKGROUND

The invention is generally directed to a closure system and a container having a closure system.

Tubes, bottles or similar containers of fluid or liquid or paste-like media include outlet openings which are closable by means of closures such as, for example, screw-on lids or snap-on protective caps.

EP1188679A2 discloses an automatic closure for resiliently deformable, tube-like or bottle-like containers of paste-like or liquid media. The closure includes a cover lid with an outlet opening and an axially movable closing member for closing said outlet opening. The closing member is realized as part of a cover-like resilient hollow body. The medium passes from the container into a space between the outside surface of the hollow body and the cover lid. As a result of pressure from the outside onto the container, the medium is pressed into the space and there exerts a compressive force onto the outside surface of the cover-like hollow body. This causes the closing member to be moved axially away from the outlet opening in opposition to the restoring force of the hollow body. Due to the overpressure in the space, the medium is pressed out of the space through the outlet opening. As the restoring forces of such membrane-like hollow bodies are often insufficient to move the closing member back again into the closed position, EP1188679A2 proposes realizing ventilation ducts to the interior of the hollow body and to the space between the outside surface of the hollow body and the cover lid. In particular in the case of media with comparatively high viscosity, the restoring force of membrane-like hollow bodies can be too small, even in combination with ventilation ducts, to displace the viscous medium and to close the valve in a reliable manner. Increasing the restoring forces, for example, as a result of greater wall thicknesses and/or as a result of choosing a different material combination, can result in unacceptably high actuating forces in particular in the case of highly viscous fillers.

In particular in the case of preservative-free media or fillers, it is important that contaminated filler is not able to flow back into the respective container after an application. This also applies analogously to air contaminated with germs and/or dirt particles. As germs are also able to pass into a container from the outside via a filler film, it is important to seal the outlet opening well in particular when it is not in use.

SUMMARY

An object of the present invention is consequently to create a closure system which is simple to operate and has a reliably sealable output opening. This object is achieved by a closure system and by a container with a closure system having one or more features of the invention.

The closure system is suitable for fastening on the output neck of a container that is realized in a tube-like or bottle-like manner. It includes an applicator which is fastened on an output neck of the container, for example, by means of a screw closure or a snap-on closure. As a result of pressure being exerted onto the container, the fluid medium is pressed out of the container into a channel of the applicator. From there it passes via through-openings into a chamber which is surrounded by a valve cover with an outlet opening. A closing body or closing member is realized and fastened on the applicator in such a manner that it is pressed from the inside surface of the chamber against a valve seat at the outlet opening by the restoring force of a resilient restoring element and, thus, closes the outlet opening if no or only a very small amount of compressive force acts from the chamber on the surface of said closing member. The closing member is preferably realized as a convexly curved portion of a membrane-like, resilient cover. The restoring element is consequently the cover itself.

In the case of alternative embodiments of the closing member, it can also include, for example, a resilient foam body and/or a spring as the resilient restoring element.

The closing member or at least the outer surface of the closing member or of the cover is impermeable to the respective filler in the container and preferably includes a thermoplastic elastomer or a material containing silicone.

The closing member is fastened on the applicator such that a compressive force that acts on the chamber-side surface of the closing member opposes the resilient restoring force of the restoring element. When the closing member abuts against the valve seat of the valve in the closed state, it is pressed against the valve seat by a remaining closing force of the restoring element. If the compressive force acting on the chamber-side surface of the closing member exceeds the closing force of the closing member, the restoring element is resiliently deformed. As a result, the closing member is released from the valve seat and an opening gap is created between the closing member and the valve cover such that the medium is able to be pressed out of the outlet opening as a result of the overpressure in the chamber. Depending on the type of the closing member and of the valve cover, the closing force at which the closing member abuts against the valve seat of the valve cover when the valve is closed can vary from location to location. In particular in the case of membrane-like closing members, the form thereof and/or the distribution of the wall thickness thereof over the entire closing member can have a considerable influence, for example, on the reaction to compressive forces acting from the outside. Thus, for example, thin places of the membrane can already deform in the case of compressive forces which are clearly smaller than the closing force. The term "closing force" consequently refers to the compressive force, which, at the corresponding pressure in the chamber relative to the atmospheric pressure, causes the closing member to begin to be released from the valve seat.

As an alternative to this, the closing body can also include a resilient foam body, preferably a foam body produced from a closed-cell foam, as the restoring element. An open-cell foam could also be used if its surface includes a thin skin that was impermeable to the medium.

The restoring element is preferably deformed as the pressure in the chamber increases such that the closing member is released from the valve seat in the axial direction with reference to the outlet opening when the closing pressure is exceeded. This is possible, for example, when the closing member is realized as a convexly curved portion of a membrane-like cover, where the compressive force of the medium is able to act on the membrane in the axial direction.

As an alternative to this or in addition to it, the closing member can also be realized such that it is deformable in the radial direction under the influence of a chamber-side compressive force. Thus, for example, the closing member could include a portion produced from a resilient foam material which comprises the shape of a cylinder, or of a cone, and which is inserted on the chamber side into a corresponding coaxial portion of the outlet opening in the valve cover. When the pressure in the chamber is increased, said resilient portion of the closing member, which at the same time is also the restoring element, is compressed, as a result of which a ring-shaped gap is created, through which the medium is able to exit out of the chamber. The compressive force acts orthogonally all over the surface of the closing member inside the chamber and can consequently comprise a radial component and/or an axial component at every point. The closure system includes a mechanical blocking element, the position of which relative to the closing member can be modified between a blocking position and a releasing position. In the blocking position, the blocking element has the effect of a mechanical stop for the closing member. This stop delimits the range of movement of the closing member and, as a result, causes the closing member itself to close the outlet opening in a reliable manner whenever the pressure in the chamber exceeds the blocking pressure. The blocking element is preferably in direct contact with the closing member in the blocking position and presses it against the valve seat at an additional blocking force. This additional blocking force supports the restoring force of the resilient restoring element. Even in the case of a medium with comparatively high viscosity, the valve is able to be closed in a reliable and tight manner when not in use. If the blocking element is moved relative to the closing member into the releasing position, it no longer acts as a stop for the closing member. As soon as the pressure in the chamber exceeds the blocking pressure, the closing member is pressed away from the outlet opening, and the medium is able to be pressed through the outlet opening. The pressure to be exerted on the tube or the container can be kept comparatively low as the restoring force of the restoring element to be overcome is also comparatively low.

The applicator preferably includes an inside part which is connected to the output neck, and an outside part which is held on the inside part so as to be movable in a guided manner. The blocking element is arranged on the inside part—the valve cover and the blocking member, in contrast, on the outside part. In this way the unit produced from the valve cover, the blocking member and the outside part of the applicator can be moved back and forth between the blocking position and the releasing position relative to the inside part of the applicator. Closure systems, where the inside part of the applicator includes a tubular portion, at the front end of which projects a blocking element that is realized in a bolt-like manner, are particularly advantageous. The outside part of the applicator can be realized in the manner of a cover which comprises on the front a guide opening through which the blocking bolt projects. The blocking bolt acts as an axial guide element for moving the outside part in the axial direction relative to the inside part of the applicator. Suitable stop means, for example a ring-shaped bead on the outside surface of the inner applicator part and two axially spaced ring-shaped beads on the inside surface of the outer applicator part delimit the range of movement of the two applicator parts relative to one another in the axial direction. As an alternative to this or in addition to such ring-shaped beads, it is possible to realize, for example on the outside surface of the inside part, radially projecting threaded cams which engage with a corresponding threaded groove on the inside surface of the outside part. As a result of rotating the outside part relative to the inside part of the applicator, it is possible to modify the axial position of the two parts relative to one another between the blocking position and the releasing position. The ends of the threaded groove or, as an alternative to this, of threaded groove portions can be utilized as stop elements which secure the blocking position and the releasing position. The adjusting of the relative axial position of the blocking element as a result of a rotation is easily and simply controllable. As a result of the dimension of the pitch of the threaded groove, it is also possible to influence the force expended to adjust the blocking element.

In the blocking position, the blocking element or the blocking bolt is in contact with the closing member and presses it against the valve seat on the inside surface of the valve cover. In the releasing position, the pulled-back locking bolt is no longer in contact with the closing member. The closing member, however, continues to abut against the valve seat and the valve continues to be closed. The closing member is not displaced from the outlet opening or the valve opened until the pressure in the chamber between the closing member and the valve cover is greater and overcomes the blocking pressure. The applicator preferably includes positive locking latching means which, in the two end positions, cause an increased force expenditure to be necessary in order to move the inside part and the outside part of the applicator relative to one another out of the blocking position or out of the releasing position.

BRIEF DESCRIPTION OF THE DRAWINGS

A preferred embodiment of the closure system according to the invention is described in more detail by way of some figures, in which.

DETAILED DESCRIPTION OF THE PREFERRED EMBODIMENTS

Figure 1:
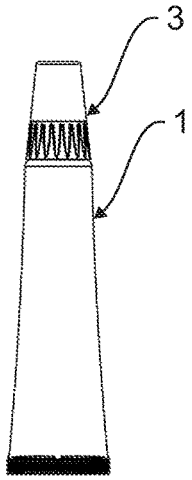
FIG. 1 shows a tube with the closure system.
Figure 2:
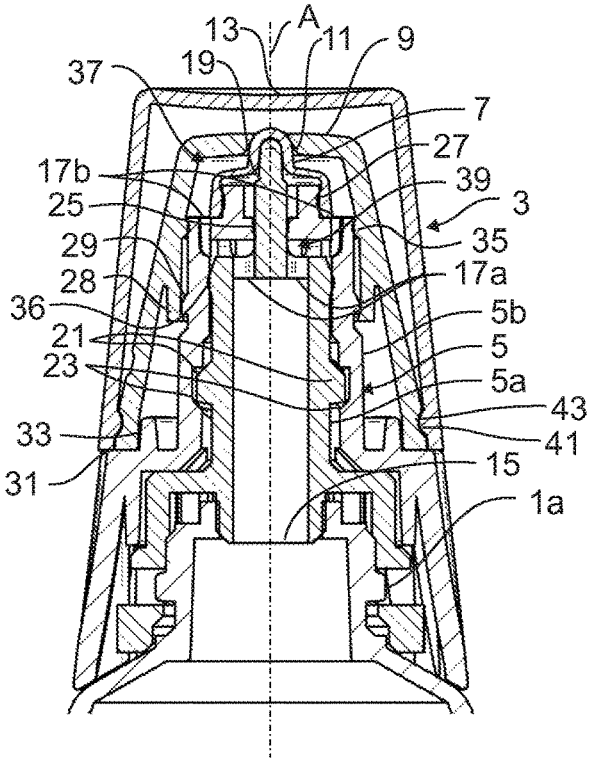
FIG. 2 shows a longitudinal section of the arrangement from FIG. 1 in the region of the closure system with the valve blocked.

FIG. 1 shows a container 1 in the form of a tube, a closure system 3 being fastened on the output neck 1*a* of the container 1. FIG. 2 shows a longitudinal section of said arrangement in the region of the closure system 3 in a blocked state which prevents the medium from escaping from the container 1 even if the medium in the container 1 is pressurized.

Figure 4:
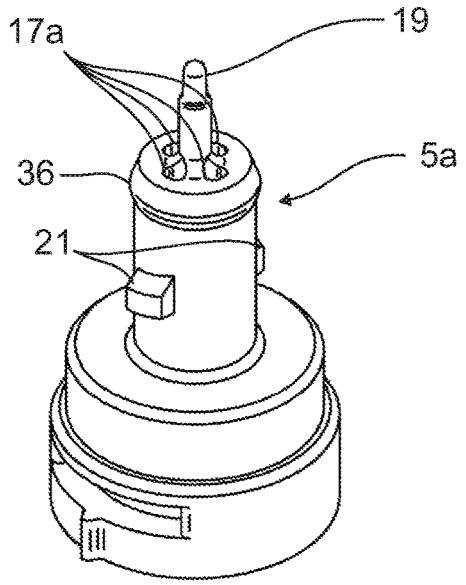
FIG. 4 shows a perspective view of the inside part of an applicator.
Figure 5:
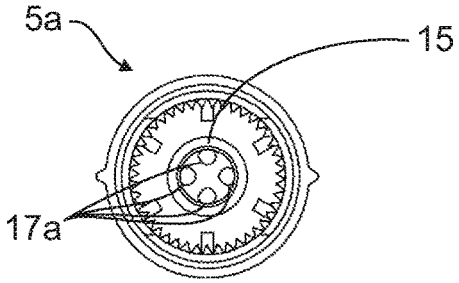
FIG. 5 shows a view of the applicator inside part from FIG. 4 seen from below.
Figure 6:
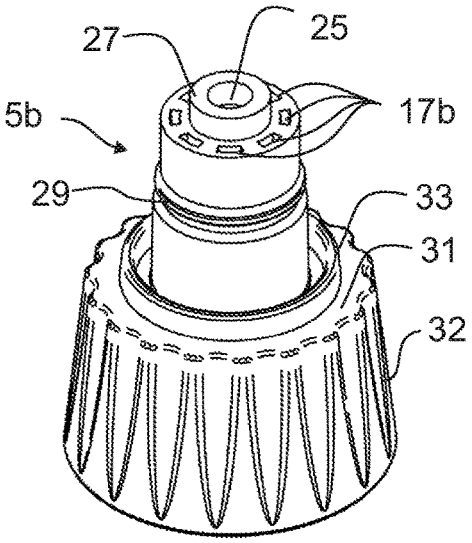
FIG. 6 shows perspective view of the applicator outside part.

The closure system 3 includes an applicator 5 with an inside part 5*a* and an outside part 5*b*. The inside part 5*a* is shown in perspective in FIG. 4 and in a view from below in FIG. 5, the outside part 5*b* is shown in an analogous manner in FIGS. 6 and 7. The applicator inside part 5*a* is fastened on the output neck 1*a*, for example by means of a snap-on connection or a screw-type connection, and includes a tube-like portion with an inlet opening 15 that faces the container 1 and one or several, for example four, primary through openings 17*a* in the region of the oppositely situated tube end. A blocking element 19 in the form of a blocking bolt, which is symmetrical with reference to a rotational axis A and has a rounded end, also projects axially there from the tube portion. Two threaded cams 21 project radially in the central region of the tube portion, on the outer lateral surface thereof. They engage with corresponding threaded groove portions 23 on the inside surface of an outer tube portion of the applicator outside part 5*b*.

Figure 7:
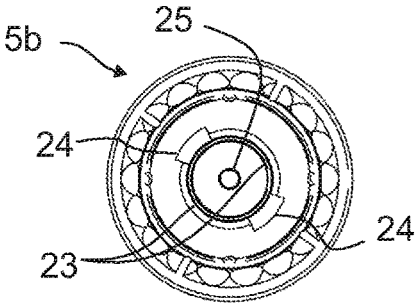
FIG. 7 shows a view of the applicator outside part seen from below.

In the view from below of the applicator outside part 5*b* in FIG. 7, two diametrically opposed ring-shaped sector-like recesses 24 can be seen on the inside surface of the applicator outside part 5*b*, through which recesses the threaded cam 21 of the applicator inside part 5*a* can be inserted into the threaded groove 23.

The outside part 5*b* is realized in a cover-like manner. It encases the inside part 5*a* and on its end-face end includes a guide opening 25, through which the blocking element 19 projects. The guide opening 25 or the inside edge of the applicator outside part 5*c* which adjoins the blocking element 19 are realized such that the blocking element 19 abuts tightly against said inside edge and can be both displaced axially in the direction of the rotational axis A and rotated about the rotational axis A relative to the applicator outside part 5*b*. Several secondary through-openings 17*b* are provided peripherally with respect to the guide opening 25 on the end-face end of the outside part 5*b*. Between said secondary through-openings 17*b* and the centrally arranged guide opening 25, the outside part 5*b* includes an axially protruding retaining ring 27.

Figure 8:
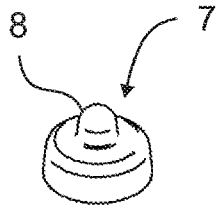
FIG. 8 shows a perspective view of a blocking member.
Figure 9:
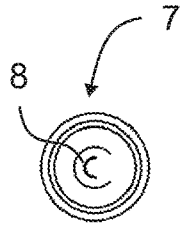
FIG. 9 shows the blocking member from FIG. 8 seen from below.
Figure 10:
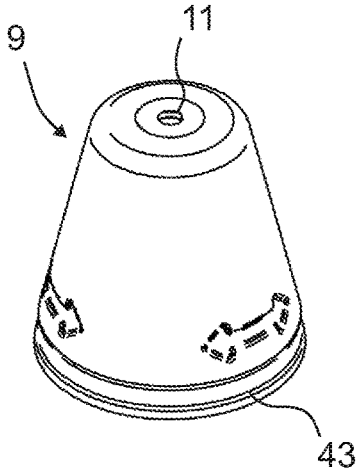
FIG. 10 shows a perspective view of a valve cover.
Figure 11:
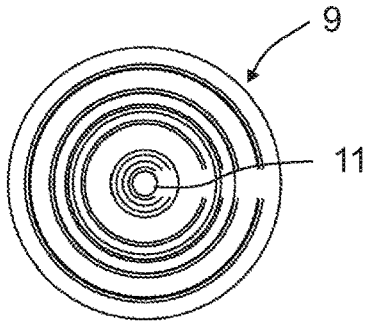
FIG. 11 shows the valve cover from FIG. 10 seen from below.
Figure 12:
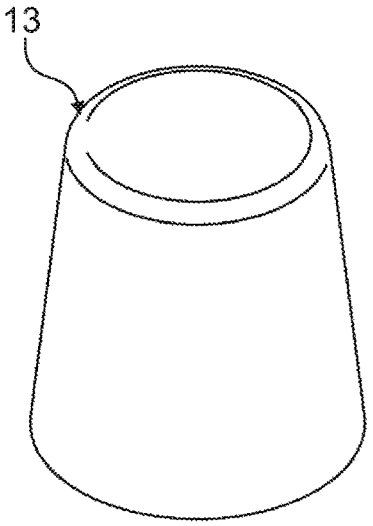
FIG. 12 shows a perspective view of a protective cap.
Figure 13:
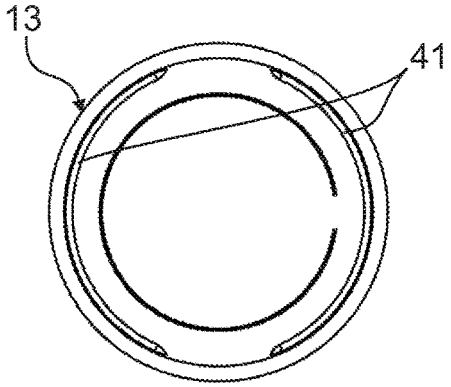
FIG. 13 shows the protective cap from FIG. 12 seen from below.

The closing member 7 is shown in perspective in FIG. 7 and from below in FIG. 8. It includes a resilient membrane-like cover, the bottom edge region of which is inverted over the retaining ring 27 and fastened to said retaining ring 27. The closing member 7 further includes a central dome-like or convexly curved closing body 8 which, on account of the resilient restoring force of the closing member 7, is pressed onto a ring-shaped valve seat at the outlet opening 11 of the valve cover 9 and thus closes the valve. The valve cover 9 is shown in perspective in FIG. 10 and from below in FIG. 11.

In the blocking position shown in FIG. 2, the blocking element 19 abuts against the inside surface of said closing body 8 and presses it axially at an additional blocking force against the valve seat on the valve cover 9. The blocking bolt and the cavity in the interior of the closing body 8 are preferably realized in a slightly conical manner. This makes it easier to insert the blocking bolt into said cavity when the closure system changes from the releasing position into the blocking position as a result of rotating the valve cover 9 or the applicator outside part 5*b* with the valve cover. In particular when the locking bolt comprises greater conicity than the cavity in the closing body 8 and the blocking bolt comprises at least in regions a greater diameter than the input diameter of the cavity in the closing body 8, the blocking bolt additionally also presses the closing body radially outward in the blocking position. As a result, the sealing of the outlet opening 11 in the blocked state is further improved.

In addition to the closing member 7, the valve cover 9 is also connected non-rotatably in a non-positive locking and/or positive locking manner to the applicator outside part 5*b*. When the closure system is produced, the valve cover 9 is inverted from the side with the closing member 7 over the applicator outside part 5*b*. In this case, resilient latching elements 28 with steps that are arranged on the inside surface of the valve cover 9 are pressed outward through a conical ring-shaped collar 29 on the outside surface of the applicator outside part 5*b*. After overcoming said ring-shaped collars 29, the latching elements 28 spring back. Due to the undercut of the latching elements 28 and of the ring-shaped collar 29, the valve cover 9 is retained on the applicator outside part 5*b*. The bottom edge of the valve cover 9, in the mounted state, rests on a shoulder 31 in the bottom region of the applicator outside part 5*b* and is additionally supported radially on the inside surface by a support ring 33. The non-rotatable connection between the valve cover 9 and the applicator outside part 5*b* can be effected as a result of non-positive locking abutment and/or as a result of portions that engage behind in a positive locking manner. In particular, for example, the outside surface of the support ring 33 and the inside surface of the valve cover can be interlocked together (not shown).

The bottom region of the applicator outside part 5*b* is preferably realized adjoining the shoulder 31 as an apron 32 with fluting on the outside which improves the grip when the outside part 5*b* and the parts non-rotatably connected thereto are rotated.

A ring-shaped bead 35, which is pressed onto the outside wall of the applicator outside part 5*b*, is realized on the inside surface of the valve cover 9 in the region of the top edge of the tubular portion of the applicator outside part 5*b*. This connection is at the same time tight and impermeable to the filler in the container 1.

The topmost region of the valve cover 9 and the outside surface of the closing member 7 delimit a chamber 37 into which the secondary through-openings 17*b* of the applicator outside part 5*b* open out. The secondary through-openings 17*b* are connected to the primary through openings 17*a* and consequently via the tubular portion of the applicator inside part 5*a* to the interior of the container 1 via a space 39 between the end-face end of the applicator outside part 5*b* and the end-face end of the applicator inside part 5*a*.

If, in the blocked state, pressure is exerted onto the media in the container 1, it does pass into the chamber 37 but cannot escape through the outlet opening 11 from the valve cover 9 as the closing member 7 is pressed against the valve seat by the blocking means 19. A further ring-shaped bead 36, which protrudes slightly radially beyond the outer lateral surface of the tubular portion in the region of the end-face end of the applicator inside part 5*a*, abuts against the inside wall of the applicator outside part 5*b*. This contact zone is sealed to the media in the space 39, even if it is slightly pressurized. The ring-shaped bead 36 is additionally a guide means which allows a relative translational movement and rotational movement of the outside part 5*b* and of the inside part 5*a* of the applicator in or about the rotational axis A.

When the closure system is not in use, the protective cover 13 can be inverted over the valve cover 9 and connected to the same so as to be re-detachable, for example by means of a snap-on connection. Two or several portions of a ring-shaped rib 41 protrude inward and a corresponding retaining groove 43 is realized on the outside surface of the valve cover for this purpose on the inside surface on the protective cover 13.

Figure 3:
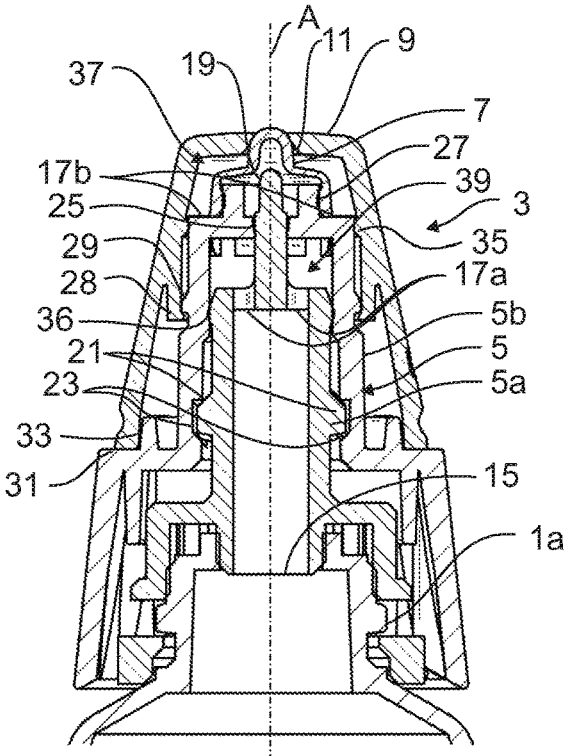
FIG. 3 shows a longitudinal section of the arrangement from FIG. 1 in the region of the closure system with the valve released and the protective cap removed.

FIG. 3 shows the closure system from FIG. 2 without the protective cap in a releasing position. Proceeding from the blocking position, the valve cover 9 is rotated relative to the applicator inside part 5*a*, which is non-rotatably connected to the container 1, about preferably approximately a quarter to a third of a full revolution. The parts that are non-rotatably connected to the valve cover 9, that is to say the applicator outside part 5*b* and the closing member 7, are also entrained in rotation. Due to the pitch of the threaded groove portions 23, which mesh with the threaded cams 21, the unit produced from valve cover 9, applicator outside part 5*b* and closing member 7 is moved away from the output neck 1*a* of the container 1 in the direction of the rotational axis A. As a result, the closing member 7 is released from the blocking element 7. At the same time, the volume of the space 39 is also somewhat enlarged. As a result of pressure onto the resiliently or plastically deformable container 1, the medium is able to be pressed into the chamber 37. If the pressure of the medium in the chamber 37 exceeds a blocking pressure, the closing member 7 is elastically deformed and releases the outlet opening 11 such that the medium is able to be pressed out.

The closure system is then moved back into the blocking position as a result of rotating the valve cover 9 in the opposite direction. At the same time, the volume of the space 39 becomes somewhat smaller again. The medium is lightly pressurized again as a result. This causes part of the medium displaced in such a manner to be pressed back in the direction of the container 1 and part of the medium to be pressed out of the closure system through the outlet opening 11 that is not yet blocked. Possible contaminants in the medium in the region of the outlet opening 11 are thus reliably expelled, as a result of which the risk of contaminating the medium in the chamber 37 can be minimized.

The closure system, in conjunction with containers 1 which are elastically or plastically deformable, is suitable for pressing the medium out of the container through the outlet opening 11. As an alternative to this, the closure system can also be used with rigid containers where the medium is pressurized in another manner, for example, by a piston or by a suitable gas.

If it is necessary to certain media for surrounding air to flow into the chamber 37 and/or into the cavity under the membrane-like closing member 7, corresponding ventilation ducts can be provided (not shown). These are preferably realized and arranged such that the air is not sucked into the valve cover 9 via the outlet opening 11 as otherwise germs or dirt particles could pass into the chamber 37. Where required, such air ducts can include filters and/or one-way valves which ensure that only clean air is able to enter and that the medium is not able to escape though said ducts.

KEY TO THE REFERENCES

1 Container
1*a* Output neck
3 Closure system
5 Applicator
5*a* Applicator inside part
5*b* Applicator outside part
7 Closing member
8 Closing body
9 Valve cover
11 Outlet opening
13 Protective cap
15 Inlet opening
17*a* Primary through-openings
17*b* Secondary through-openings
19 Blocking element
21 Threaded cams
23 Threaded groove portions
25 Guide opening
27 Retaining ring
28 Latching elements
29 Ring-shaped collar
31 Shoulder
33 Support ring
35 Ring-shaped bead
37 Chamber
39 Space
41 Rib

The invention claimed is:

1. A closure system for a container (1) of paste or liquid media, which container is realized as a tube or bottle and includes an output neck (1*a*), said closure system comprising an applicator which is connectable to the output neck (1*a*) and includes a channel with a container-side inlet opening (15) and at least one through-opening (17*a*, 17*b*), a valve with a valve cover, the at least one through-opening leading to a chamber (37) which is delimited on an outside by the valve cover (9), said valve cover (9) comprises an outlet opening (11) with a valve seat, and a closing member (7) of the valve is fastened on the applicator and is movable between an open position, in which a pressure of the paste or liquid media in the chamber acting on a chamber side surface of the closing member (7) elastically deforms the closing member and releases the outlet opening (11), and a closing position, in which the closing member is pressed from an inside surface of the chamber (37) against the valve seat by a restoring force of a resiliently deformable restoring element and, as a result, closes the outlet opening (11), and a mechanical blocking element (19), a relative position of which with respect to the closing member (7) is modifiable between a releasing position and a blocking position, wherein the blocking element (19) prevents the valve from opening in the blocking position, but not in the releasing position.

2. The closure system as claimed in claim 1, wherein the applicator includes an applicator inside part (5*a*) and an applicator outside part (5*b*), the applicator inside part (5*a*) is fastenable on the output neck (1*a*) and includes the blocking element (19), the valve cover (9) and the closing member (7) are fastened on the applicator outside part (5*b*), and the applicator outside part (5*b*) is mounted so as to be movable relative to the applicator inside part (5*a*) such that the position of the blocking element (19) relative to the closing member (7) is modifiable between the blocking position and the releasing position.

3. The closure system as claimed in claim 2, wherein the channel is a tubular portion of the applicator inside part (5*a*), and the blocking element (19) is a locking bolt which projects axially at an end-face end of said tubular portion.

4. The closure system as claimed in claim 3, wherein the applicator outside part (5*b*) includes a tubular portion which encases the applicator inside part (5*a*), a guide opening (25), through which the locking bolt projects, is provided on an end-face of the applicator outside part (5*b*), and the applicator outside part (5*b*) is movable axially relative to the applicator inside part (5*a*) between the blocking position and the releasing position.

5. The closure system as claimed in claim 4, further comprising radially projecting threaded cams (21) on the applicator inside part (5*a*), said threaded cams (21) engage with corresponding threaded groove portions (23) on an inside surface of the applicator outside part (5*b*), and the applicator outside part (5*b*) is adjustable relative to the applicator inside part (5*a*) due to a pitch of the threaded groove portions (23) as a result of rotation between the blocking position and the releasing position.

6. The closure system as claimed in claim 4, further comprising a retaining ring (27) that projects on the end-face end of the applicator outside part (5*b*) coaxially and peripherally with respect to the guide opening (25), and the closing member (7) includes a resilient membrane cover, and a bottom edge region of said cover is fastened on the retaining ring (27).

7. The closure system as claimed in claim 4, wherein the blocking element (19), in the blocking position, is in abutment with the closing member (7) and presses said closing member against the valve seat on the valve cover (9), and the blocking element (19), in the releasing position, is at such a spacing with respect to the closing member (7) that said closing member is movable as a result of overpressure on a side of the chamber (37) in order to release the outlet opening (11).

8. The closure system as claimed in claim 6, wherein the applicator outside part (5*b*) includes secondary through-openings (17*b*) which open out into the chamber (37) peripherally with respect to the retaining ring (27) and connect said chamber (37) to a space (39) which is connected to the channel of the applicator inside part (5*a*) by primary through-openings (17*a*).

9. The closure system as claimed in claim 1, wherein the applicator includes an applicator inside part (5*a*) and an applicator outside part (5*b*), and the valve cover (9) is non-rotatably connected to the applicator outside part (5*b*).

10. A container (1) for paste or liquid media comprising an output neck (1*a*) and a closure system as claimed in claim 1 connected to the output neck (1*a*).

* * * * *